US005652946A

United States Patent [19]

Scheuer et al.

[11] Patent Number: 5,652,946

[45] Date of Patent: Jul. 29, 1997

[54] AUTOMATIC SETUP OF INTERDOCUMENT ZONE PATCHES AND RELATED TIMING

[75] Inventors: Mark A Scheuer, Williamson, N.Y.; Peter J. McGuire, Devon, England

[73] Assignee: Xerox Corporation, Stamford, Conn.

[21] Appl. No.: 672,821

[22] Filed: Jun. 28, 1996

[51] Int. Cl.[6] ..... G03G 15/00

[52] U.S. Cl. ..... 399/49; 399/74

[58] Field of Search ..... 355/208, 246, 355/203, 204, 214; 324/71.1, 452; 399/49, 74

[56] References Cited

U.S. PATENT DOCUMENTS

| | | | |
|---|---|---|---|
| 4,341,461 | 7/1982 | Fantozzi | 355/246 |
| 4,647,184 | 3/1987 | Russell et al. | 355/208 |
| 5,122,835 | 6/1992 | Rushing et al. | 355/208 |
| 5,210,572 | 5/1993 | MacDonald et al. | 355/208 |
| 5,386,276 | 1/1995 | Swales et al. | 355/246 |
| 5,410,388 | 4/1995 | Pacer et al. | 355/208 |
| 5,491,536 | 2/1996 | Mashiba et al. | 355/208 |
| 5,543,896 | 8/1996 | Mestha | 355/208 |

*Primary Examiner*—Arthur T. Grimley
*Assistant Examiner*—Sophia S. Chen
*Attorney, Agent, or Firm*—Ronald F. Chapuran

[57] ABSTRACT

A method of automatically positioning a test pattern in the interdocument zone of an imaging surface of a printing machine using a sensor with a given field of view. Once the test pattern has been provided in the interdocument zone of the imaging surface, the timing relationship of the test pattern to a plurality of edges of the sensor field of view is determined. The control then responds to the timing relationships to locate the sensor field of view with respect to the test pattern and determine the time period between creating a test pattern and sensing the test pattern.

12 Claims, 4 Drawing Sheets

AUTOMATIC SETUP OF INTERDOCUMENT ZONE PATCHES AND RELATED TIMING

BACKGROUND OF THE INVENTION

The invention relates to xerographic process control, and more particularly, to the improvement for the use of existing sensors to monitor and automatically set up interdocument zone patches.

In copying or printing systems, such as a xerographic copier, laser printer, or ink-jet printer, a common technique for monitoring the quality of prints is to artificially create a "test patch" of a predetermined desired density. The actual density of the printing material (toner or ink) in the test patch can then be optically measured to determine the effectiveness of the printing process in placing this printing material on the print sheet.

In the case of xerographic devices, such as a laser printer, the surface that is typically of most interest in determining the density of printing material thereon is the charge-retentive surface or photoreceptor, on which the electrostatic latent image is formed and subsequently, developed by causing toner particles to adhere to areas thereof that are charged in a particular way. In such a case, the optical device for determining the density of toner on the test patch, which is often referred to as a "densitometer", is disposed along the path of the photoreceptor, directly downstream of the development of the development unit. There is typically a routine within the operating system of the printer to periodically create test patches of a desired density at predetermined locations on the photoreceptor by deliberately causing the exposure system thereof to charge or discharge as necessary the surface at the location to a predetermined extent.

The test patch is then moved past the developer unit and the toner particles within the developer unit are caused to adhere to the test patch electrostatically. The denser the toner on the test patch, the darker the test patch will appear in optical testing. The developed test patch is moved past a densitometer disposed along the path of the photoreceptor, and the light absorption of the test patch is tested; the more light that is absorbed by the test patch, the denser the toner on the test patch.

In any printing system using test patches for monitoring print quality, a design problem inevitably arises of where to place these test patches, particularly on photoreceptor belts or drums. Xerographic test patches are traditionally printed in the interdocument zones on the photoreceptor. They are used to measure the deposition of toner on paper to measure and control the tone reproduction curve (TRC). Generally each patch is about an inch square that is printed as a uniform solid half tone or background area. This practice enables the sensor to read one value on the tone reproduction curve for each test patch. However, that is insufficient to complete the measurement of the entire curve at reasonable intervals, especially in a multi-color print engine. To have an adequate number of points on the curve, multiple test patches have to be created. Thus, the traditional method of process controls involves scheduling solid area, uniform halftones or background in a test patch. Some of the high quality printers contain many test patches. During the print run, each test patch is scheduled to have single halftone that would represent a single byte value on the tone reproduction curve.

Various prior art techniques have been proposed to improve the use of test patches for xerographic control. For example, pending application Ser. No. 08/527,616 filed Sep. 13, 1995 discloses a method of development control by storing a reference tone reproduction curve and providing a single test pattern including a scale of pixel values in the interdocument zone of the imagining surface. The system senses the test pattern along the scale of pixel values in the interdocument zone and responds to the sensing of the test pattern and the reference tone reproduction curve to adjust the machine operation for print quality correction. It is also known in the prior art, for example, U.S. Pat. No. 4,341,461 to image multiple test targets in the interdocument zones of the photoreceptor. For example, two test targets each having two test patches are selectively exposed singly or in overlapping relationship to provide test data to control toner dispensing and developer bias.

A difficulty with the prior art systems, however, is the timing of the placement of test patches in the interdocument zone and timing of the subsequent sensing of the test patch. Correct timing is necessary for correct readings and often differences in the inherent operation of machines and the placement of sensors in the machine results in error in the readings. Also, since timing relationships are often manually set up by service representatives, inconsistency and further error can be introduced into the machine xerographic control.

It would be desirable, therefore, to be able to improve the timing in generating and reading test patches as well as to improve timing without additional costly components. It would also be desirable to improve accuracy, eliminate machine to machine differences, and reduce set up time for a machine control.

It is an object of the present invention therefore to provide a new and improved technique for process control, in particular, for automatically timing the generation of test patches using existing machine sensors. It is another object of the present invention to sense a test pattern in a timing relationship to the edges of a sensor field of view and locate the sensor field of view with respect to the test pattern.

Other advantages of the present invention will become apparent as the following description proceeds, and the features characterizing the invention will be pointed out with particularity in the claims annexed to and forming a part of this specification.

SUMMARY OF THE INVENTION

The present invention is concerned with a method of automatically positioning a test pattern in the interdocument zone of an imaging surface of a printing machine using a sensor with a given field of view. Once the test pattern has been provided in the interdocument zone of the imaging surface, the timing relationship of the test pattern to a plurality of edges of the sensor field of view is determined. The control then responds to the timing relationships to locate the sensor field of view with respect to the test pattern and determines the time period between creating a test pattern and sensing the test pattern.

For a better understanding of the present invention, reference may be had to the accompanying drawings wherein the same reference numerals have been applied to like parts and wherein:

DETAILED DESCRIPTION OF THE DRAWINGS

DETAILED DESCRIPTION OF THE PREFERRED EMBODIMENT

Figure 1:
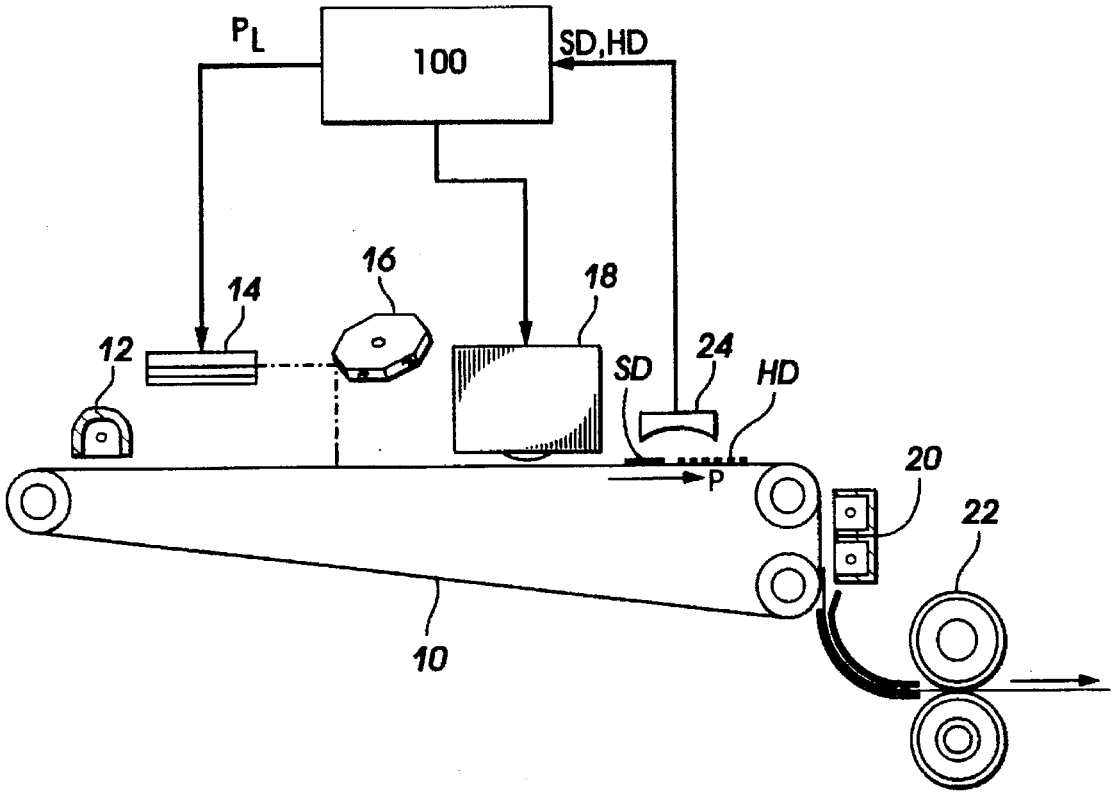
FIG. 1 is an elevational view illustrating a typical electronic imaging system incorporating tone reproduction curve control in accordance with the present invention.

FIG. 1 shows the basic elements of the well-known system by which an electrophotographic printer or laser printer uses digital image data to create a dry-toner image on plain paper. There is provided in the printer a photoreceptor 10, which may be in the form of a belt or drum, and which comprises a charge-retentive surface. The photoreceptor 10 is here entrained on a set of rollers and caused to move (by means such as a motor, not shown) through process direction P. Moving from left to right in FIG. 1, there is illustrated the basic series of steps by which an electrostatic latent image according to a desired image to be printed is created on the photoreceptor 10, subsequently developed with dry toner, and transferred to a sheet of plain paper.

The first step in the electrophotographic process is the general charging of the relevant photoreceptor surface. As seen at the far left of FIG. 1, this initial charging is performed by a charge source known as a "scorotron", indicated as 12. The scorotron 12 typically includes an ion-generating structure, such as a hot wire, to impart an electrostatic charge on the surface of the photoreceptor 10 moving past it. The charged portions of the photoreceptor 10 are then selectively discharged in a configuration corresponding to the desired image to be printed, by a raster output scanner or ROS, which generally comprises laser source 14 and a rotatable mirror 16 which act together, in a manner known in the art, to discharge certain areas of the charged photoreceptor 10. Although a laser source is shown to selectively discharge the charge-retentive surface, other apparatus that can be used for this purpose include an LED bar, light emitting diode, or, conceivably, a light-lens system. The laser source 14 is modulated (turned on and off) in accordance with digital image data fed into it, and the rotating mirror 16 causes the modulated beam from laser source 14 to move in a fast-scan direction perpendicular to the process direction P of the photoreceptor 10. The laser source 14 outputs a laser beam of laser power PL which charges or discharges the exposed surface on photoreceptor 10, in accordance with the specific machine design.

After certain areas of the photoreceptor 10 are (in this specific instance) discharged by the laser source 14, remaining charged areas are developed by a developer unit such as 18 causing a supply of dry toner to contact the surface of photoreceptor 10. The developed image is then advanced, by the motion of photoreceptor 10, to a transfer station including a transfer scorotron such as 20, which causes the toner adhering to the photoreceptor 10 to be electrically transferred to a print sheet, which is typically a sheet of plain paper, to form the image thereon. The sheet of plain paper, with the toner image thereon is then passed through a fuser 22, which causes the toner to melt, or fuse, into the sheet of paper to create the permanent image.

As shown, a densitometer generally indicated as 24 is used after the developing step to measure the optical density of a solid density test patch (marked SD) or a halftone density test patch (HD) created on the photoreceptor 10 using the laser source 14, an independent patch generator, or similar device in a manner known in the art. The word "densitometer" is intended to apply to any device for determining the density of print material on a surface, such as a visible-light densitometer, an infrared densitometer, an electrostatic voltmeter, or any other such device which makes a physical measurement from which the density of print material may be determined in a suitable control such as illustrated at 100. In a system such as the above described system, an electrostatic voltmeter is generally used to measure the surface potential on the photoreceptor provided by a charging device. It should be noted that sensors such as an ESV, ETAC or paper densitometer have an effective aperture of a few millimeters that represents the view area.

Copiers and printers often rely on electrostatic readings e.g. Electrostatic Volt Meters (ESV) and infrared densitometer readings e.g. Toner Area Coverage (TAC) Sensors from special interdocument zone patches to maintain system process controls. Proper timing of the readings involves two separate processes: (1) careful control of process element tolerances including the mounting positions of the ESVs, the TACS, and the Patch Generator and (2) careful setup of the location of the interdocument zone patches, in two dimensions. Often special diagnostic routines including Patch Generator timing and Patch Position (inboard/outboard) are used.

Given the relatively large field of view of ESVs (often as much as 14 mm) and the limited size of the interdocument zone patches (18–24 mm), machine-to-machine tolerances must be maintained to within a few millimeters. Software processing time variations and photoreceptor module mounting variability can result in additional millimeter variations in the position of the field of view relative to the patch.

As the process speed is increased, the total variation in the patch timing requires additional hardware costs to provide accurate patch readings, including the use of peak and minimum hold circuits to make the readings less sensitive to machine-to-machine differences. A different approach is to use actual sensor readings to locate the patch and set the proper read timing to eliminate the machine-to-machine differences in the physical locations of sensors, patch generator, and photoreceptor.

Figure 2:
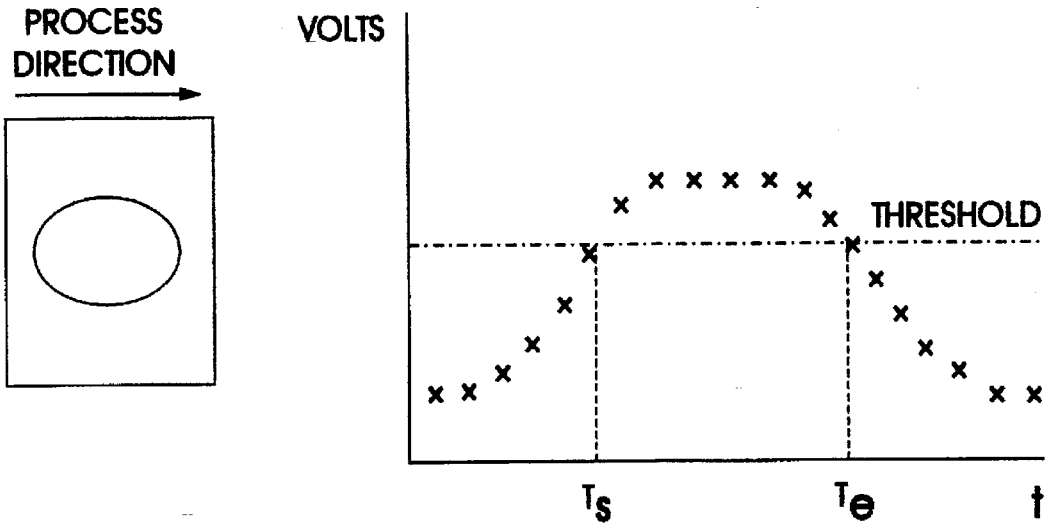
FIG. 2 is a graph illustrating the setting of sensor read timing in accordance with the present invention.

In accordance with the present invention, the ESV read timing is set via an NVM non volatile setting that is used for all machines, only being adjusted for differences between the xerographic and paper handling modules (page sync vs pitch reset). In this new approach, the timing is determined by sampling the ESVs at a high frequency after the ROS generates an interdocument zone patch. The time the reading surpasses a threshold as shown at times $T_s$ $T_e$ (see FIG. 2) is noted and a fixed time is added or subtracted to place the field of view properly and repeatably within the patch. This measured time becomes the read timing for all subsequent ESV reads. Separate read timings are determined for each ESV.

Once the charge patch is properly located in the interdocument zone, fine tuning of the size of the solid density test patch is also done automatically. When using a patch generator, insufficient "on" time will result in excessively high voltages at one or both ends of the patch due to the failure to completely expose the charge voltage down to the toner patch voltage. Excessive "on" time of the patch generator will result in low voltages outside the desired patch area due to excessive exposing of background areas. The patch generator timing can be easily set to produce the proper voltage at each edge by adjusting the patch generator timing while sampling the ESV at a high frequency in a similar fashion used to set the ESV read timing (see FIG. 2).

Once the patch generator timing is established the TAC sensor can read the interdoucment zone. Using the thresholding technique used by the ESV above (see FIG. 2), an optimum TAC sensor read timing can be established to place the field of view repeatably within all subsequent toner patches.

Figure 3:
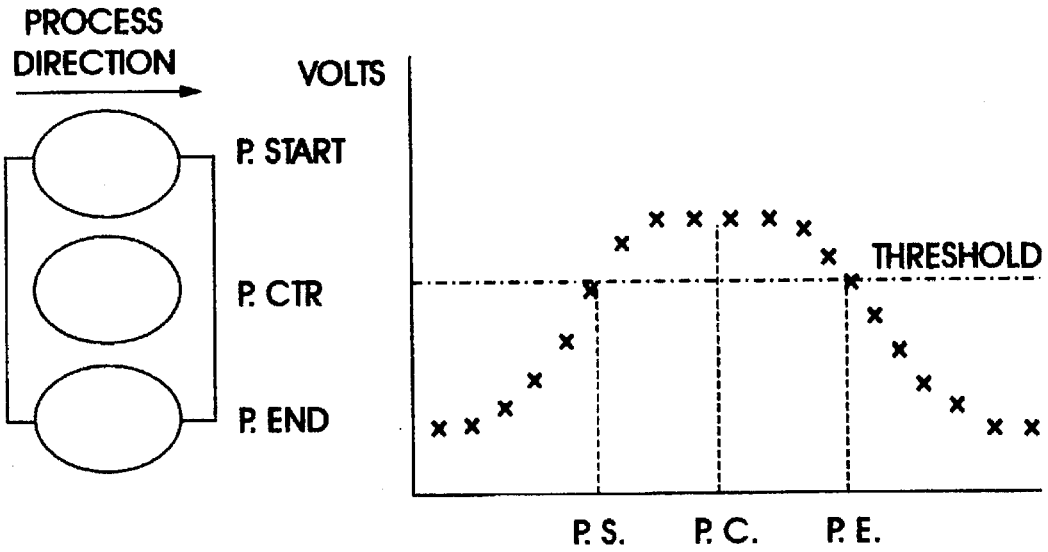
FIG. 3 is a graph illustrating the setting of patch vertical position in accordance with the present invention.

Vertical patch position can be done automatically by locating the patch to an extreme outboard position, for example, and moving the patch inboard during each subsequent adjustment. All appropriate sensors locate the patch, for example, patch at start of threshold, P.S., patch at center of threshold, P.C., and patch at end of threshold P.E., (see FIG. 3) and an optimal position is determined. The measurements could also be used to determine the actual field of view of the individual sensors, which vary with vertical position from the photoreceptor, their position relative to the photoreceptor centerline, and/or their angular displacement from a line perpendicular to the photoreceptor The service representative would be informed if the positioning of any of the sensors was outside of specification.

Figure 4:
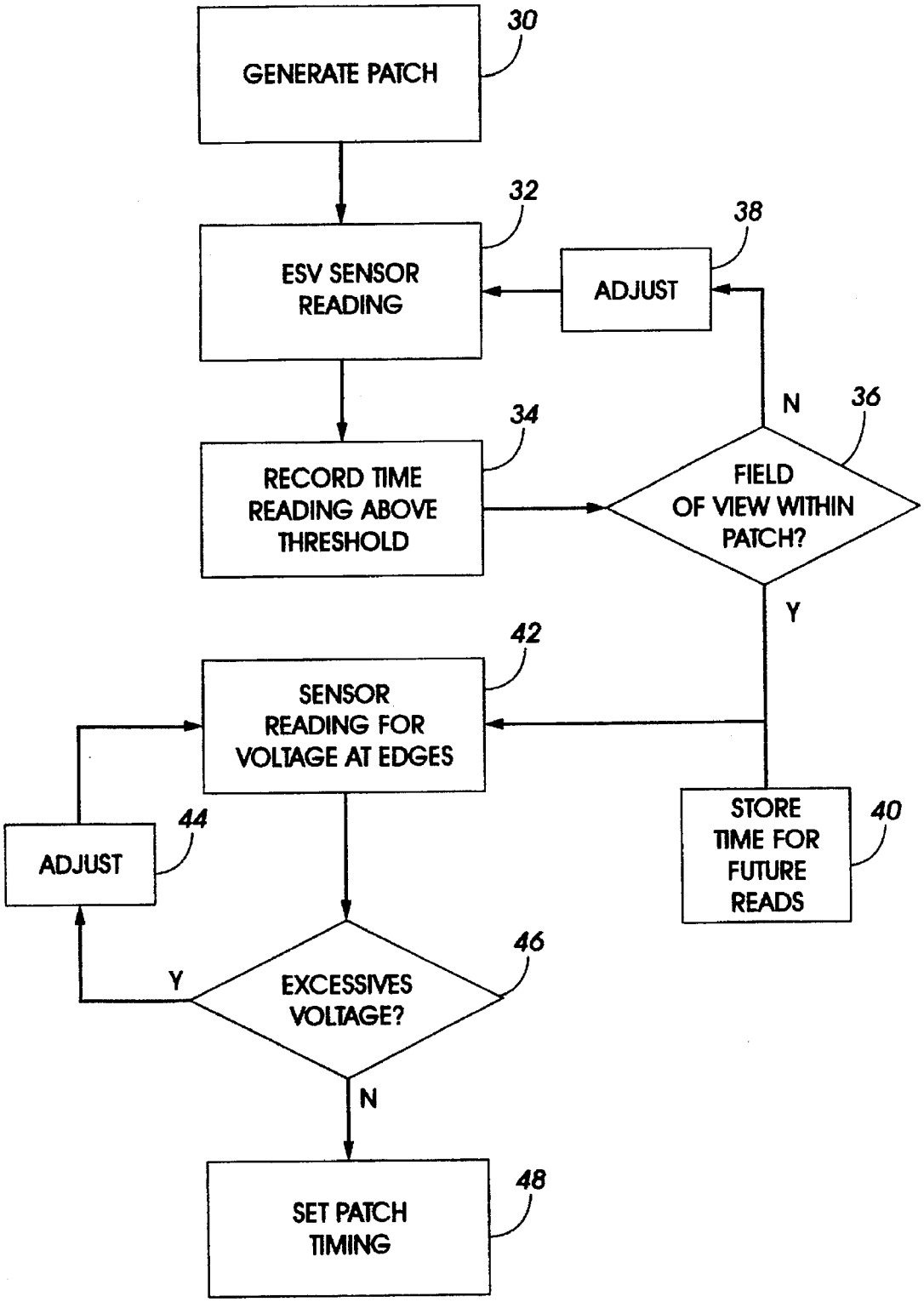
FIGS. 4 and 5 are flow charts illustrating patch timing in accordance with the present invention.
Figure 5:
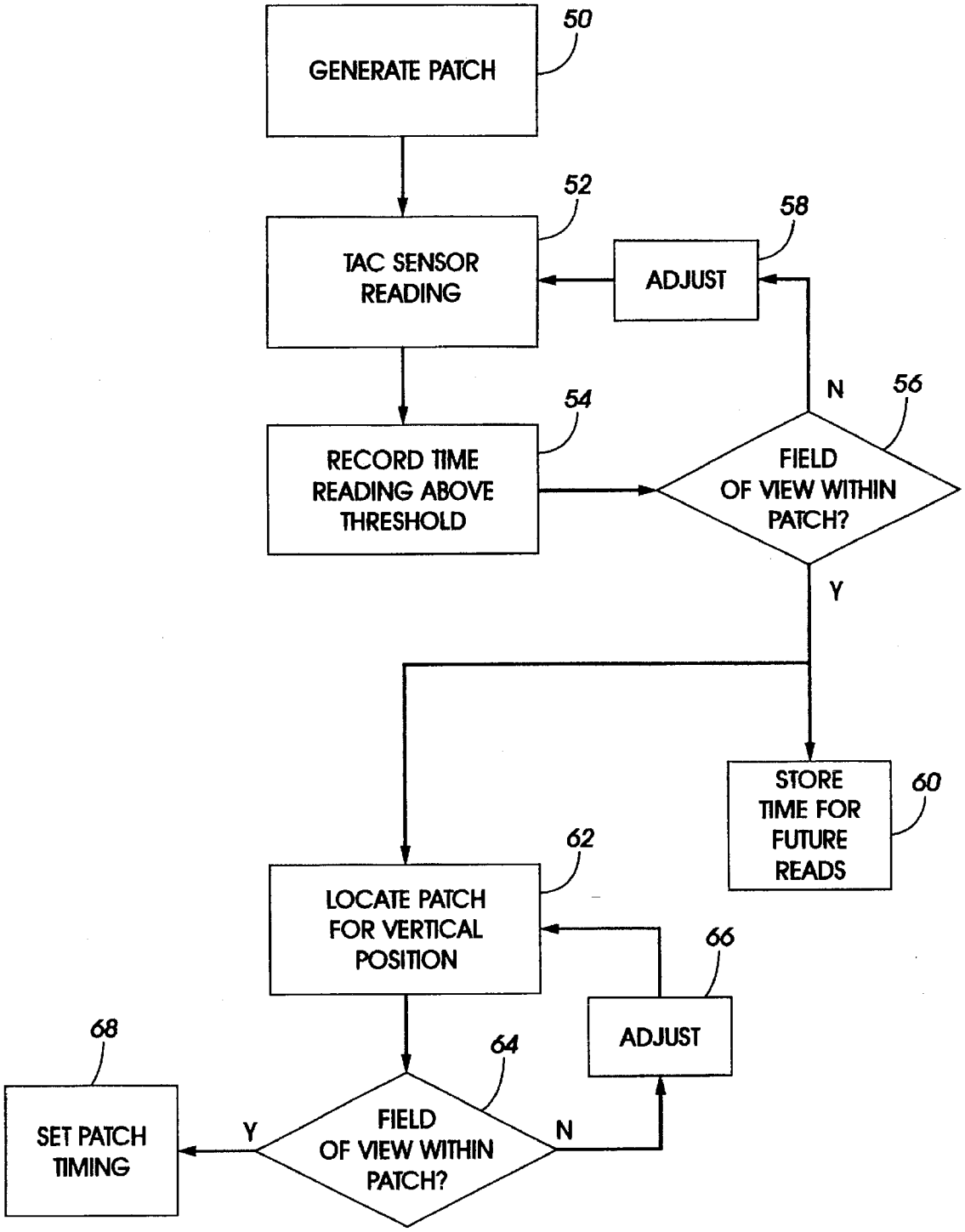

One method of automatic timing set up for patches is illustrated in FIGS. 4 and 5. Block 30 illustrates the generation of a patch and an ESV sensor reading obtained as shown at block 32. Block 34 represents the recording of the time from patch generation to sensor readings, in particular readings above a threshold. Based upon the readings, a determination of whether or not the patch is within the sensor field of view is made as shown by decision block 36. If not, successive adjustments or movements of the patch shown in block 38 are made until the patch is determined to be within the field of view and the appropriate times are stored as illustrated at block 40.

Once the patch is properly located within the interdocument zone, the patch generator on/off timing is fine tuned by sampling the ESV sensor for excessively high voltages at one or both ends of the patch as illustrated at block 42. If excessive voltage is determined, adjustments to the patch are made, block 44, until no excessive voltage is determined. At this point, the patch timing is set shown in block 48. All the adjustments up to this point may be made, in some cases it is preferable, with the developer system off or disabled. This prevents gross errors until the system is calibrated. For the TAC sensor, the developer system becomes necessary.

Once the patch generator timing is established, a patch is generated shown at block 50. The TAC sensor can read the interdocument zone, block 52, and establish the proper read timing values, again using the thresholding techniques, blocks 52 and 54. Decision block 56 represents confirmation of the position of the patch within the TAC field of view and block 58 shows changes to the patch position or length, if required. Once the patch location is accepted, the appropriate reading times are stored and the patch is located for vertical position as illustrated at block 60. Vertical patch position is done by moving the patch to an extreme outboard position and then moving inboard during each subsequent adjustment as shown in blocks 62, 64, and 66. Once the vertical position is located, the patch timing is set as shown at 68.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In a printing machine having a moving imaging surface, a projecting system for modulating a beam and projecting an image onto the imaging surface, a developer for application of toner to the image projected onto the imaging surface for transfer of the image to a medium, a sensor for monitoring machine status, the sensor having a given field of view, a method of automatically positioning the test pattern on the imaging surface comprising the steps of;

providing a test pattern in the inter-image zone of the imaging surface, sensing the test pattern in timing relationship to a first edge of the sensor field of view, sensing the test pattern in a timing relationship to a second edge of the sensor field of view, and responding to the timing relationships of sensor field of view and test pattern edges to locate the sensor field of view with respect to the test pattern.

2. The method of claim 1 including the step of determining the time period between creating a test pattern and sensing the test pattern.

3. The method of claim 2 wherein the step of determining the time period between creating a test pattern and sensing the test pattern includes the step of storing an indication of the time period in non-volatile memory.

4. The method of claim 1 wherein the step of locating the sensor field of view with respect to the test pattern includes the step of locating the sensor field of view within the center of the test pattern.

5. The method of claim 1 wherein the sensor monitors a developed test pattern on the imaging surface.

6. In a printing machine having a moving imaging surface, a projecting system for modulating a beam and projecting an image onto the imaging surface, a developer for application of toner to the image projected onto the imaging surface for transfer of the image to a medium, a sensor for monitoring a developed test pattern on the imaging surface, the sensor having a given field of view, a method of automatically positioning the test pattern on the imaging surface comprising the steps of;

providing a test pattern in the inter-image zone of the imaging surface, sensing the test pattern in timing relationship to a plurality of edges of the sensor field of view, responding to the timing relationships of sensor field of view and test pattern edges to locate the sensor field of view with respect to the test pattern, and determining the time period between creating a test pattern and sensing the test pattern.

7. In a printing machine having a moving imaging surface, a projecting system for modulating a beam and projecting an image onto the imaging surface, the projecting system periodically generating an interdocument test patch on the imaging surface, a developer for application of toner to the image projected onto the imaging surface for transfer of the image to a medium, the machine including an ESV sensor and an IRD sensor, the sensors having a given field of view, a method of automatically positioning the test pattern on the imaging surface comprising the steps of;

sampling the ESV sensor reading after the generation of a test patch, marking the time the sensor reading surpasses a given threshold, adding a fixed time to place the field of view within the patch, storing the measured time for subsequent ESV sensor reads, and fine tuning the projection system generating an interdocument test patch on the imaging surface by sampling the ESV sensor readings to determine excessive or insufficient on time.

8. The method of claim 7 wherein the step of determining insufficient on time includes the step of determining excessively high voltages at one end of the test patch.

9. The method of claim 7 wherein the step of determining excessive on time includes the step of determining low voltages outside the patch area test patch.

10. The method of claim 7 including the step of reading the interdocument zone by the IRD sensor by marking the time the IRD sensor reading surpasses a given threshold to determine the measured time for subsequent IRD sensor reads.

11. In a printing machine having a moving imaging surface, a projecting system for modulating a beam and projecting an image onto the imaging surface, the projecting system periodically generating an interdocument toner patch on the imaging surface, a developer for application of toner to the image projected onto the imaging surface for transfer of the image to a medium, the machine including an ESV sensor and an IRD sensor, the sensors having a given field of view, a method of automatically positioning the test pattern on the imaging surface comprising the steps of;

sampling the ESV sensor reading after the generation of a test patch, marking the time the sensor reading surpasses a given threshold, adding a fixed time to place the field of view within the patch, storing the measured time for subsequent ESV sensor reads, reading the interdocument zone by the IRD sensor by marking the time the IRD sensor reading surpasses a given threshold to determine the measured time for subsequent sensor reads.

12. In a printing machine having a moving imaging surface, a projecting system for modulating a beam and projecting an image onto the imaging surface, the projecting system periodically generating an interdocument test patch on the imaging surface, a developer for application of toner to the image projected onto the imaging surface for transfer of the image to a medium, the machine including an ESV sensor and IRD sensor, the sensors having a given field of view, a method of automatically positioning the test patch on the imaging surface comprising the steps of; locating the test patch to an extreme off patch position, sampling the reading for each sensor after the generation of the test patch, marking the time each sensor reading surpasses a given threshold, moving the patch inwardly for successive sensor measurements and adjustments of each sensor, and calculating an optimal position for the test patch.

* * * * *